US006763948B2

(12) United States Patent
Ballman et al.

(10) Patent No.: US 6,763,948 B2
(45) Date of Patent: Jul. 20, 2004

(54) SCREENING MACHINE WITH ACCELERATION MODIFICATION

(75) Inventors: Brady P. Ballman, Loveland, OH (US); Daniel Ferris, Cincinnati, OH (US); Stephen C. Mitchell, Mason, OH (US); Jeff Pielage, West Chester, OH (US); Anthony J. Yanka, Sharonville, OH (US)

(73) Assignee: Rotex, Inc., Cincinnati, OH (US)

( * ) Notice: Subject to any disclaimer, the term of this patent is extended or adjusted under 35 U.S.C. 154(b) by 178 days.

(21) Appl. No.: 10/062,592

(22) Filed: Jan. 31, 2002

(65) Prior Publication Data

US 2003/0015460 A1 Jan. 23, 2003

Related U.S. Application Data

(60) Provisional application No. 60/306,947, filed on Jul. 20, 2001.

(51) Int. Cl.[7] ..... B07B 1/42

(52) U.S. Cl. ..... 209/320; 209/365.1; 209/365.4

(58) Field of Search ..... 209/311, 315, 209/317, 320, 322, 341, 344, 365.1, 365.2, 365.3, 365.4, 415

(56) References Cited

U.S. PATENT DOCUMENTS

| | | | | | |
|---|---|---|---|---|---|
| 54,895 | A | | 5/1866 | Griswold | |
| 93,721 | A | | 8/1869 | Kirkwood | |
| 112,141 | A | | 2/1871 | Hammond et al. | |
| 158,110 | A | | 12/1874 | Michel | |
| 185,526 | A | | 12/1876 | Harnish | |
| 390,948 | A | | 10/1888 | Cuskley | |
| 422,043 | A | | 2/1890 | Stone | |
| 581,671 | A | | 4/1897 | Bishop | |
| 1,611,255 | A | | 12/1926 | Sturtevant | |
| 2,102,826 | A | | 12/1937 | Wurzbach et al. | |
| 2,312,477 | A | * | 3/1943 | Pollitz | 209/329 |
| 2,378,499 | A | * | 6/1945 | Rapp | 209/415 |
| 2,439,543 | A | | 4/1948 | Ketchum | |
| 2,876,891 | A | | 3/1959 | Long et al. | |
| 3,317,041 | A | * | 5/1967 | Century | 209/315 |
| 4,260,051 | A | | 4/1981 | Burghart | |
| 4,795,552 | A | * | 1/1989 | Yun et al. | 209/319 |
| 5,037,536 | A | * | 8/1991 | Koch et al. | 209/325 |
| 5,301,814 | A | | 4/1994 | Lower et al. | |
| 5,730,297 | A | | 3/1998 | Lower et al. | |
| 6,019,216 | A | | 2/2000 | Patterson | |
| 6,382,424 | B1 | * | 5/2002 | Bolton et al. | 209/405 |
| 6,508,364 | B2 | * | 1/2003 | Kreft et al. | 209/309 |

OTHER PUBLICATIONS

FMC Corporation, *FMC The First Name in Food Handling Systems*, Promotional Materials, 1995.
FMC Corporation, *Syntron Volumetric Feeder Machines*, Promotional Materials, 1994.
FMC Corporation, *FMC Express Lite—Your Destination for Food Handling*, Promotional Material, 1996.
FMC Corporation, *Syntron VF Vibrating Conveyor*, Promotional Materials, 1994.
PCT/US02/22729, *Search Report*, Dec. 11, 2003.

* cited by examiner

*Primary Examiner*—Donald P. Walsh
*Assistant Examiner*—Joseph Rodriguez
(74) *Attorney, Agent, or Firm*—Wood, Herron & Evans, LLP

(57) ABSTRACT

A screening machine of the type used to separate or classify mixtures of solid particles of different sizes includes a fixed base and a perforate screen deck mounted for movement relative to the base during a screening operation. Leaf springs connect the tail end of the screen deck to the fixed base so that the leaf springs support the tail end of screen deck for movement relative to the base. The leaf springs are oriented horizontally to avoid introducing vertical movement to the screen deck as it moves to and from the head and tail ends. The leaf springs are offset or deflected when the machine is at rest or in the neutral mid-point of its stroke. This arrangement advantageously utilizes the bias of the leaf springs to accelerate, assist or enhance movement of the screen deck during portions of its stroke and likewise to decelerate, hinder or retard the movement during other portions of its stroke. With an appropriate offset, an increase in the effectiveness of the screening process (i.e., fewer defective particles passing through the screen deck) while a decrease in the screening time is attained.

47 Claims, 5 Drawing Sheets

SCREENING MACHINE WITH ACCELERATION MODIFICATION

This claims the benefit of U.S. Provisional Patent Application Serial No. 60/306,947, filed Jul. 20, 2001 and hereby incorporated by reference in its entirety.

BACKGROUND OF THE INVENTION

This invention relates generally to screening machines of the type used to separate or classify mixtures of particles of different sizes. More particularly, the invention relates to a mechanism and method for supporting and moving a screen deck within the screening machine.

In screening machines of the type described, a screen is mounted in what is often called a "screen deck" which includes a supporting peripheral frame around the perimeter of the screen. The screen deck may include one or more screens and the screen(s) may be woven, an aperture plate or another design. Typically associated with this screen deck are other material handling elements which are moved with the screen and form walls or partitions above or below the screen for containing the liquid and/or particulate materials adjacent to the screen and directing them to appropriate outlets. These elements may comprise a top cover and a pan beneath the screen. In the case of screening machines with multiple screens or deck units, spacer pans or frames are provided between the multiple screens.

The screen deck is releasably mounted to a carrier, frame, table or box to which vibratory motion is imparted, typically by one or more eccentric motors or other means of excitation. The carrier, frame, table or box and associated screen deck are referred to herein as a "screen box". The screen box may be moved in oscillatory, vibratory, gyratory, gyratory reciprocating, fully gyratory, rotary or another type of motion or combinations thereof, all of which are herein collectively referred to as "vibratory" motion or variations of that term.

Screening machines of this type are used for a wide variety of applications. For example, in a plastics factory, a granular material is often produced as an intermediate product prior to being processed into the end product. The plastic granulate particles are often referred to as "pellets" and have a specific size and shape. The uniformity of the pellets make it possible to accurately meter the quantity to be fed to the machine which produces the end product. The precise metering is very important for reducing the amount of waste. Therefore, the pellet manufacturer attempts to produce granular material which is absolutely uniform with regard to shape and size. However, in many cases and for various reasons, defective pellets are unavoidable, even if it is only in small quantities. This defective granular material can be of various types. For example, a number of individual pellets may be stuck together (three or four particle groups, etc.), pellets which are much longer than a desired size (over lengths or "longs") or pellet strands in which the individual pellets are partly but not completely cut (bead chains) are commonly manufactured. The irregular pellets to be screened and separated from acceptable particles can have a wide variety of shapes (straight particles with many times the length of normal particles such as the longs, twisted partly cut strands, etc.). All these defective pellets make accurate metering impossible, and therefore lead to a significant waste quantity for final processing.

The problem of prevention or subsequent separation of waste particles not only occurs in the production of plastic pellets but is also encountered wherever a heap of uniformly shaped and sized particles or material is to be produced by a corresponding manufacturing process, e.g. molding, compacting or cutting, whereby they can also be an end product and not an intermediate product as is the case with plastics (e.g. activated carbon pressed articles, granulated foodstuffs, etc.).

Since defective granulate particles cannot generally be prevented in the various manufacturing processes, the problem of optimum separation of these waste particles which, if not separated, signify a reduction in the value of the finished or intermediate product, exists.

Prior attempts to separate the waste particles by screening processes of various types have been only marginally successful. Commonly, prior methods have failed because the longs or straight shaped particles corresponding to the desired cross-section, but having many times the desired length, are placed on end by the screening movement and then drop vertically through the sieve opening, i.e. are not held back. One source of such problems in the screening operations is vertical or movement of the screen in a direction perpendicular to the screen. Movement of the screen in such an out-of-plane direction tends to up-end the pellets and provides them the opportunity for proper orientation to pass through the screen. As such, longs or long pellets are not separated out.

A less intense screening movement, i.e. a lower amplitude of vibration admittedly prevents the long, straight shaped pellets from being vertically positioned, but the screen surface then becomes clogged within a short period of operation by near-mesh sized material or defective granulate. The longer that the defective particles remain atop the screen, the more likely they will have an opportunity to pass through or clog the screen. The partly cut, three-dimensionally curved strands (bead chains) also hook themselves into the sieve openings, making it necessary to manually remove such defective granulate every so often. These problems also occur if oblong perforated plates or long mesh sieve netting are used. The use of step sieves (step perforated plates) does not ensure the trouble-free separation of defective granular material from the heap.

The problem is therefore to find an improved method and associated system which reliably and cost-effectively permits the separation of waste particles, minimizes the time the defective pellets are on the screen, and reduces, if not eliminates, out-of-plane or vertical movement of the screen.

SUMMARY OF THE INVENTION

The above-described and other problems with prior art screening machines and associated methods have been resolved by this invention. Presently preferred embodiments of this invention include a screening machine with a fixed base and a perforate screen deck mounted for movement relative to the base during a screening operation. The screen deck includes a head end, a tail end and a longitudinal axis extending between the head and tail ends. An inlet is provided to discharge particulate matter to be screened onto the perforate screen deck near the head end. A pair of outlets are located near the tail end of the screen deck, with one of the outlets discharging defective particulate matter that remains atop the perforate screen deck and the other outlet discharging acceptable particulate matter that passes through the perforate screen deck. A collection pan is located below the screen deck to collect the particulate material that passes through the screen deck prior to being discharged through the second outlet.

A drive motor is coupled to the screen deck near the head end to impart two-dimensional vibratory motion within a plane to the screen deck to promote separation of the particulate material by the screen deck. The vibratory motion is defined in part by longitudinal movement of the screen deck in a direction generally parallel with the longitudinal axis toward and away from the head end.

In accordance with one aspect of the present invention, a mounting assembly for the screen deck includes at least one leaf spring connecting the tail end of the screen deck to the fixed base so that the leaf spring supports the tail end of screen deck for movement relative to the base. The leaf spring(s) are oriented horizontally to avoid introducing vertical movement to the screen deck as it moves to and from the head and tail ends. Since the leaf spring(s) are oriented horizontally, the only motion of the screen deck at the tail or discharge end is longitudinally, general linear motion while the motion at the head end is vibratory motion within the two-dimensional plane.

In one preferred embodiment, each outer end of each leaf spring is bolted or otherwise secured to a mounting bracket affixed to one of the side walls of the screen deck. Each such mounting bracket includes a plate that extends parallel to the side wall of the screen deck and a tab that extends outwardly from the plate and away from the side wall. The inner central portion of each leaf spring is bolted or otherwise secured to a tab extending upwardly from the base of the machine. Preferably, the tab is fixed and does not move, deflect or bend during operation of the machine so that the screen deck moves in a longitudinal direction, i.e., between the head and tail ends, during a screening operation.

In another embodiment, the mounting assembly includes preferably four leaf springs, but at least two leaf springs. The springs are assembled into a spring pack for supporting the tail end of the screen deck on the base. The springs in the leaf pack are generally parallel, and oriented perpendicular to the longitudinal axis of the screen deck when the springs are not flexed. The central portion of the two inner springs are secured to the tab extending upwardly from the base. The central portions of the two outer springs are each secured to the bottom of the screen deck. The corresponding outer ends of all the leaf springs are secured to each other in a spaced arrangement to maintain the parallel relationship of the unflexed springs. One of the principle advantages of this mounting assembly is that the significant tension and compression forces of the flexing springs are not transferred to the base and the screen deck. The generally symmetrical design of the spring pack provides support for all the loads present, including the weight of the screen deck as well as bending/flexing and twisting/torsional motion of the springs throughout the stroke of the screen deck. As a result, stress on the mounting brackets is reduced to likewise reduce fatigue failures possible with other designs.

In accordance with another aspect of the present invention, the leaf springs are offset or deflected when the machine is in the neutral mid-point of its stroke. This arrangement advantageously utilizes the resulting bias of the leaf springs to accelerate, assist or enhance movement of the screen deck during portions of its stroke and likewise to decelerate, hinder or retard the movement during other portions of its stroke. In one embodiment, the leaf springs are initially deflected or offset by spacers positioned between the outer ends of the springs and the tabs extending outwardly from the mounting brackets. Alternatively, the springs can be mounted to the screen deck in an offset, flexed or deflected position.

With an appropriate offset, the leaf springs promote a slow advance of the screen deck toward the tail end and a quicker return movement toward the head end that works on the inertia of the material being processed on the screen deck. With such an arrangement, the time that the longs or defective pellets are on top of the screen deck is reduced, thereby minimizing the opportunities for them to pass through the screen deck along with the properly sized pellets. The biased arrangement of the leaf springs also increases the effectiveness of the screening process (i.e., fewer defective pellets passing through the screen deck) while decreasing the screening time. The amount of offset, and the direction of the offset, is determined by the application, machine specifications or other parameters to achieve desired results.

Therefore, according to this invention, the effectiveness of the screening operation is increased and the speed with which the screening operation is accomplished is likewise increased due in large part to the leaf spring mounting arrangement for the screen deck and the biased loading of the springs relative to the stroke of the screen deck.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figures 1, 2:
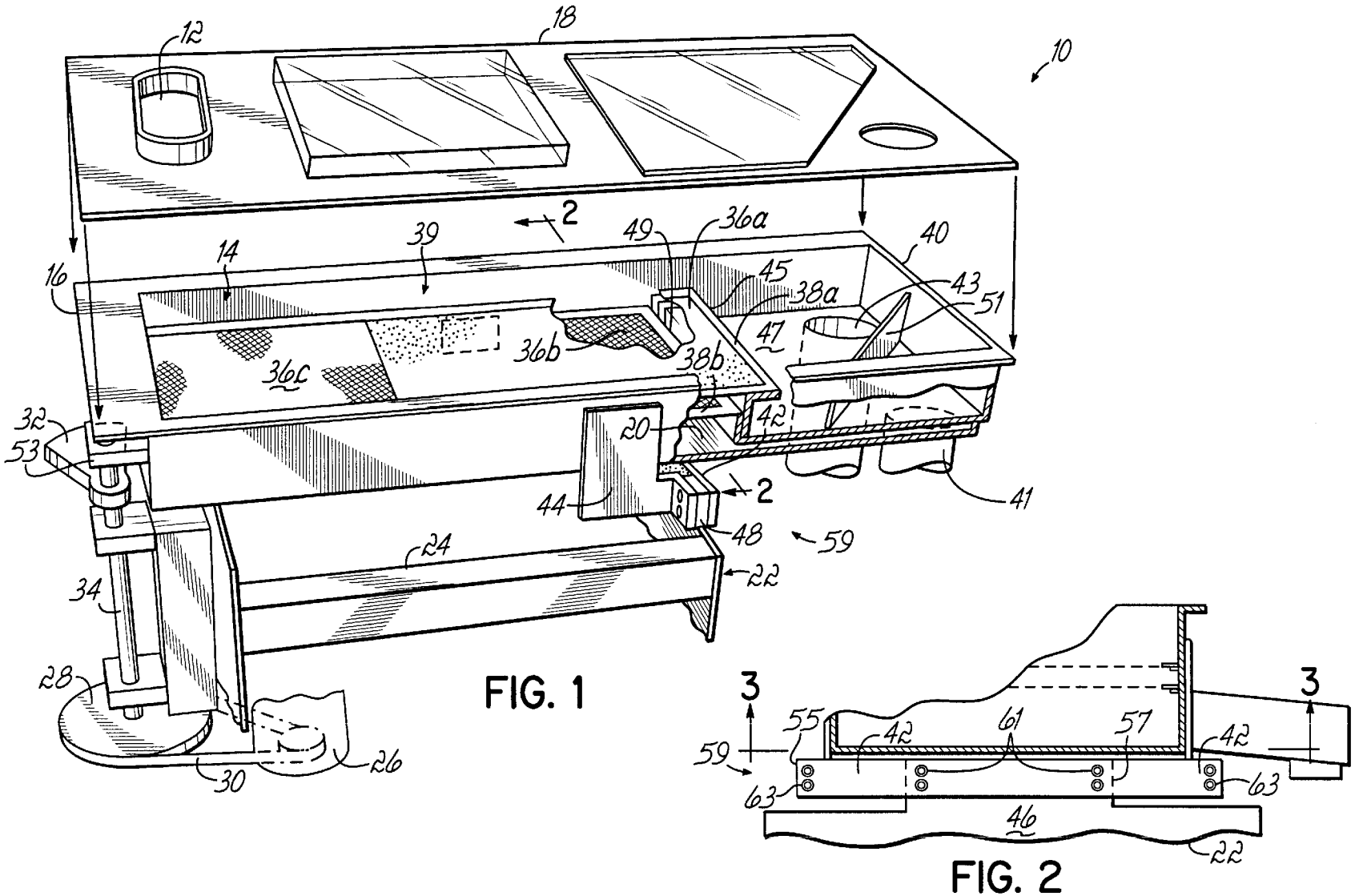
FIG. 1 is a perspective, partially disassembled and partially broken away view of a first embodiment of a screening machine according to this invention.
FIG. 2 is a cross-sectional view taken along line 2—2 of FIG. 1 of a leaf-spring mounting arrangement for a screen deck according to the embodiment of FIG. 1.

Referring to FIG. 1, a first presently preferred embodiment of a screening machine 10 in which the present invention may be used is shown. Screening machines of many types are sold commercially by Rotex, Inc. of Cincinnati, Ohio, the assignee of this invention. However, this invention is not limited to any particular type of screening machine design or application and the machine shown and disclosed herein is shown for illustrative purposes.

The screening machine 10 includes an inlet port 12 near an inlet section 14 proximate a head end 16 of the machine 10. The screening machine 10 may also include a top cover 18 in any one of a variety of forms. Particulate or other material to be screened is fed into the inlet port 12 from a hopper (not shown) for screening and processing by the machine 10.

The screening machine 10 is supported structurally by a base frame 22 including upper and lower end plates connected together by longitudinally oriented struts 24 on each side of the screening machine 10. The screening machine 10 includes an electric motor 26 attached to a pulley 28 by a belt 30 below the machine 10. The motor 26 is coupled by the belt 30 to a drive weight 32 supported on a shaft 34 to impart an oscillatory, vibratory, gyratory, gyratory reciprocating, fully gyratory, other motion or combinations thereof (herein collectively referred to as "vibratory" motion or variations of that term) to the head end 16.

Within a screening chamber of the screening machine 10, one or more screens 36 are each mounted in a perimeter screen frame 38 and in combination form a screen deck 39 to receive the material being screened from the feed chute 12 at the head end 16 of the machine 10. The screens 36, screen frames 38 and screen deck 39 are mounted on slightly sloping planes (approximately 4°) with the head end thereof being slightly elevated relative to the foot end so that during the screening process the material advances, in part by gravity, toward the foot or discharge end 40 of the machine 10. Even though the screen frames 38, screens 36 and screen deck 39 of the screening machine 10 may be on a slightly sloping plane, to provide a reference for the purposes of clarity herein, these components will be considered to be generally horizontal and the direction perpendicular or orthogonal to the screens 36 will generally be referred to as a vertical orientation, direction or attitude. Nevertheless, because of the benefits of this invention, the screens 36 may, in fact, be horizontal and the material still advances toward the foot end 40.

The driver 26 may be in the form of a gear motor or a traditional drive with shaft 34, belt 30, bearings and the like. The screen deck 39 is preferably driven eccentrically at the head end 16 and includes linear motion at the foot end 40 in opposite directions generally parallel to the longitudinal axis of the screen deck 39 as in many Rotex brand separators. The screen deck 39 includes a pan 20 to collect the screened goods such as pellets or other items. The screen 36 and frames 38 are small, light weight and pretensioned for easy installation and replacement on the machine 10.

In the embodiment of the screening machine 10 shown in FIG. 1, the screen deck 39 includes two screens 36*a*, 36*b* mounted generally parallel to each other and fixed a spaced distance apart in the screen deck 39. The screen deck 39 having dual screen frames 38*a*, 38*b* of this type is commonly referred to as a "double pass" screen deck 39. Accordingly, as the material to be screened is deposited from the inlet port 12 onto the upper screen 36*a*, the vibratory motion of the screen deck 39 advances the material across the top of the upper screen 36*a* toward the tail end 40. Appropriately sized and configured pellets pass through the upper screen 36*a* and fall onto the lower screen 36*b*. The upper screen 36*a* may include a fine mesh portion 36*c* adjacent the inlet port 12 through which dust and other fine particulate matter passes for collection and discharge. Unfortunately, certain longs also pass through the upper screen 36*a* and are deposited on the lower screen 36*b*. Therefore, the lower screen 36*b* is included to provide an additional separating mechanism for the appropriately sized particles to pass through the second lower screen 36*b* for collection in the lower pan 20 and discharge through an outlet or exit port 41.

The longs and other unacceptably shaped particles either remain atop the first upper screen 36*a* and fall off the terminal edge 45 of the frame 38*a* into a collection basin 47 for discharge through an outlet or reject port 43. Longs that pass through the upper screen 36*a* and remain atop the lower screen 36*b* fall off the terminal edge 49 of the lower screen frame 38*b* and into the collection basin 47 for discharge through the reject port 43. The discharge and reject ports 41, 43 are separated by a baffle 51 to keep the classified particles separate from one another.

In the embodiment shown in FIG. 1, the upper screen 36*a* is approximately two inches longer than the lower screen 36*b* to allow for the efficient discharge of the longs atop the upper and lower screens 36*a*, 36*b*. It would be readily appreciated by one of ordinary skill in the art that the dual pass screen deck arrangement shown and described herein is only one of many available screen deck arrangements that can be utilized with this invention.

The head or feed end 16 of the screen deck 39 is supported with a bearing shoulder 53 on the motor assembly. Support at the tail or discharge end 40 of the screen deck 39 is accomplished by a mounting assembly 59 which in one embodiment includes one or more leaf springs 42 that bear the weight of the screen deck 39 to establish a gap of preferably about 1/16 to 1/8 of an inch from the base 22. As such, there is no frictional interface between the base 22 and the screen deck 39.

In the embodiment of FIGS. 1–3A, preferably one leaf spring 42 is used in a generally horizontal orientation. The leaf spring 42 is preferably made of Scotch-Ply™ available from Cytec Engineering. The leaf spring 42 is preferably oriented horizontally to avoid introducing vertical movement to the screen deck 39 as it moves to and from the head and tail ends 16, 40. Since the spring 42 is oriented horizontally, the only motion of the screen deck 39 at the tail or discharge end 40 is longitudinally, generally linear motion. Prior screening machines commonly orient leaf springs in a generally vertical or non-horizontal direction and a pendulum type of motion is imparted to the screen deck 39. The resulting "hop" of the screen deck 39 creates a vertical component that is detrimental to the efficiency of the separation of the particles at the tail end 40 of the machine 10. In contrast, the horizontal orientation of the leaf spring 42 in this invention maintains a flat or horizontal movement of the screen deck 39 at the tail end 40.

Each outer end 55 of each leaf spring 42 is bolted or otherwise secured to one of two mounting brackets 44 each extending from the screen deck 39. A central or intermediate portion 57 of the leaf spring 42 is secured by bolts 61 or the like to a tab 46 extending upwardly from the base 22 of the machine 10. Preferably, the tab 46 is fixed and does not move, deflect or bend during operation of the machine 10.

The screen deck 39 moves in the longitudinal direction (i.e., between the head and tail ends) a distance referred to as the "stroke" of the movement. When the machine 10 is at rest, the screen deck 39 is commonly positioned generally in the center of its stroke with the springs unflexed and when operation begins, the screen deck 39 moves toward the head or tail end 16, 40 a distance equal to half of its stroke, then returns in the opposite direction a full stroke distance, once again returns in the opposite direction a full stroke distance and so on.

One aspect of this invention is to initially offset or bias the leaf spring(s) 42 to assist (accelerate) and/or retard (decelerate) the movement of the screen deck 39 over portions of its stroke movement with the bias of the spring(s) 42. Conventionally, the leaf spring(s) 42 would not be flexed when the screen deck 39 is at the mid-point of its stroke. Therefore, the leaf spring(s) 42 would deflect equally in both the head and tail end 16, 40 directions during the cyclic stroke movement of the screen deck 39. However, one aspect of this invention is to offset or deflect the leaf spring(s) 42 when the machine 10 is at rest or in the neutral mid-point (N) of its stroke and thereby utilize the bias of the leaf spring(s) 42 to accelerate, assist or enhance the movement in a first direction of the screen deck 39 during portions of its stroke and/or to decelerate, hinder or retard the movement in a second opposite direction during other portions of its stroke. As such, the rate of movement of the screen deck 39 in the first direction is greater than the rate in the second direction.

Figure 3:
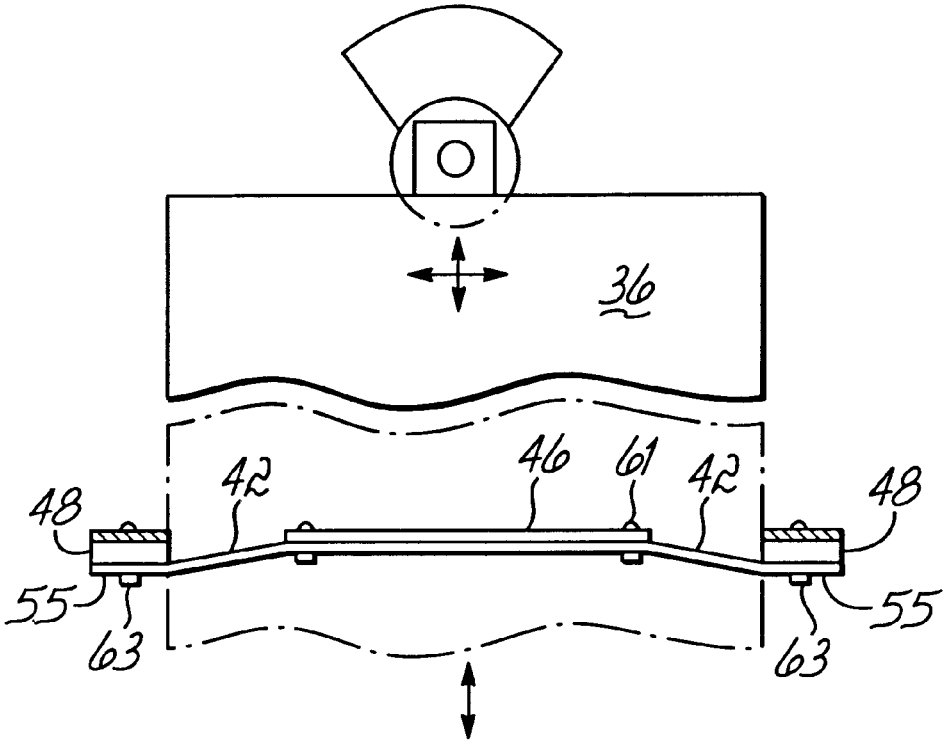
FIGS. 3 and 3A are cross-sectional views taken along line 3—3 of FIG. 2 of alternative mounting arrangements for the leaf springs.
Figure 3A:
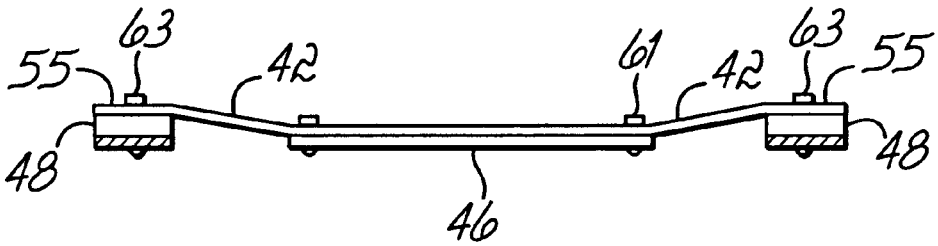

The leaf spring 42 is initially deflected or offset as shown particularly in FIGS. 3 and 3A by shims 48 secured with bolts 63 positioned between the outer ends 55 of the spring 42 and the mounting brackets 44. With an appropriate offset and shim 48 arrangement, the leaf spring 42 promotes a slow advance of the screen deck 39 toward the tail end 40 and a quicker return movement toward the head end 16. This arrangement utilizes the inertia of the material being processed on the screen deck 39 to advance the material, pellets or the like toward the tail end 40. With such an arrangement as shown by example in FIG. 3A, the time that the longs or defective particles are on top of the screen deck 39 is reduced, thereby minimizing the opportunities for them to appropriately orient for passage through the screen(s) 36 along with properly sized particles or pellets. With such an arrangement, it has been discovered that the effectiveness of the screening process (i.e., fewer defective particles pass through the screen(s) 36) is increased while the screening time (the elapsed time for the particles to move from the inlet port 12 to the discharge ports 41, 43) is decreased.

For example, on one embodiment of the screening machine 10, the leaf spring 42 was offset initially ⅞ inch toward the tail end (TE) 40 of the machine 10, similar to the arrangement shown in FIG. 3A.

Figure 4:
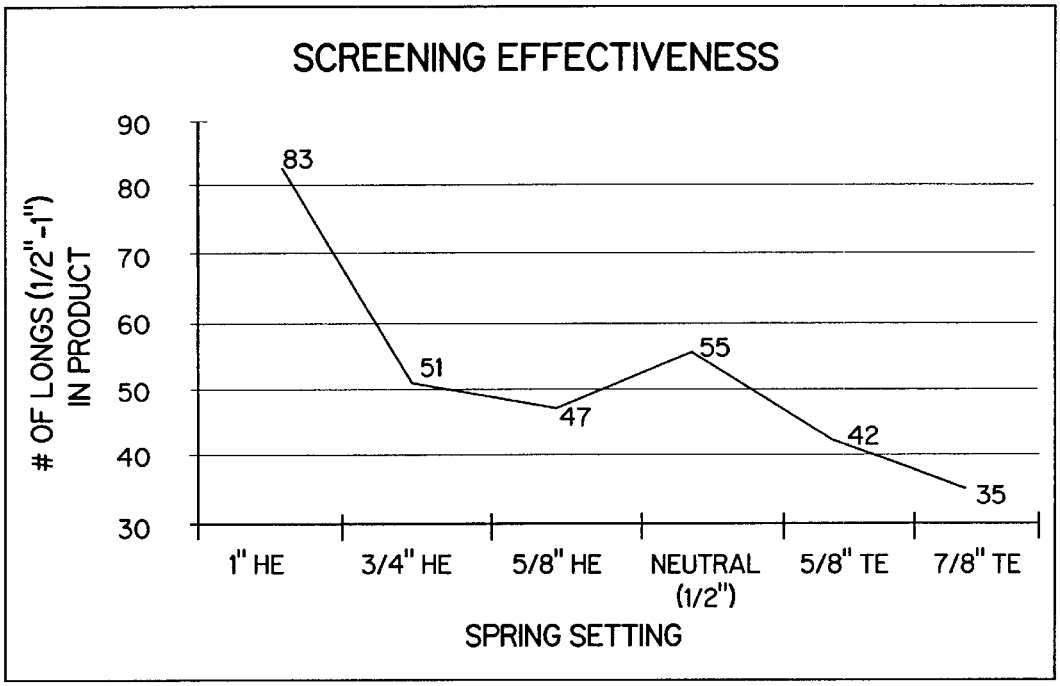
FIG. 4 is a plot of the screening effectiveness versus a biasing position of the leaf springs in one embodiment.

Referring to FIG. 4, the ⅞ inch offset toward the tail end 40 resulted in a significant increase in screening effectiveness. Specifically, only 35 longs were discharged through the exit port 41 with the ⅞ inch offset as compared to 55 longs and 83 longs with no offset (neutral) and one inch head end (HE) 16 offset, respectively, for the same total quantity of screened product or pellets.

Figure 5:
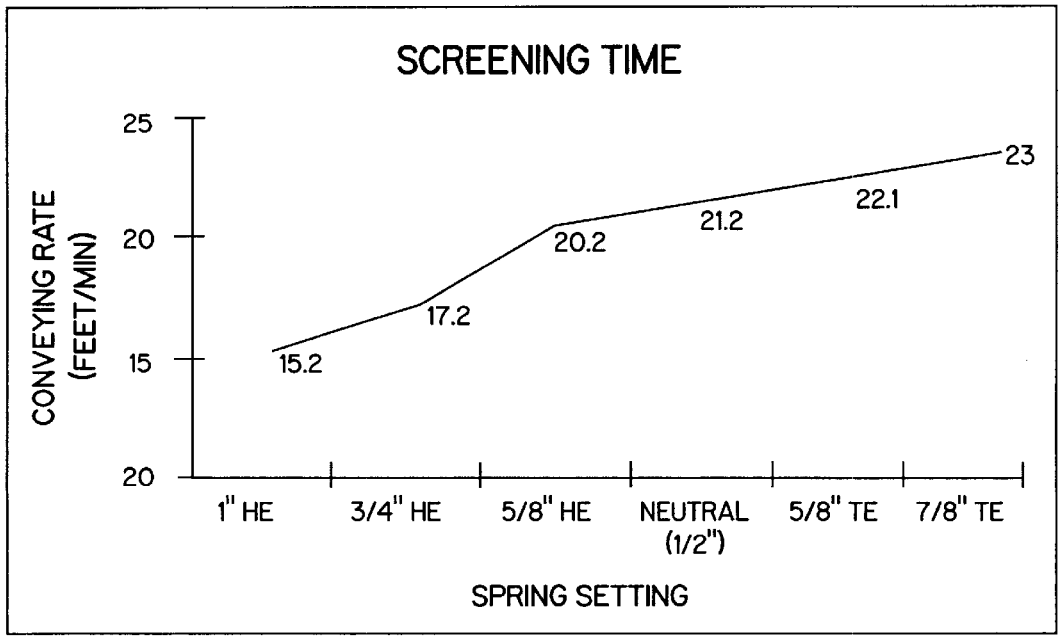
FIG. 5 is a plot of the screening time versus biasing position of the leaf springs in the embodiment referenced in FIG. 4.

Moreover, referring to FIG. 5, the screening time is reduced and the conveying rate of the product or pellets on the screen deck 39 is correspondingly increased with the ⅞ inch TE offset. This is due to the increased acceleration of the screen deck 39 from the tail end 40 to the head end 16 and the inertia of the pellets or product atop the screens 36. As such, according to this invention, the screening effectiveness, as well as the screening rate or speed, is increased with appropriate leaf spring 42 settings.

In other applications, the movement of the screen deck 39 toward the tail end 40 may be accelerated or assisted and oppositely directed movement retarded or hindered (see FIG. 3). The amount of offset is determined by the application, machine specifications or other parameters to achieve desired results.

Figure 6:
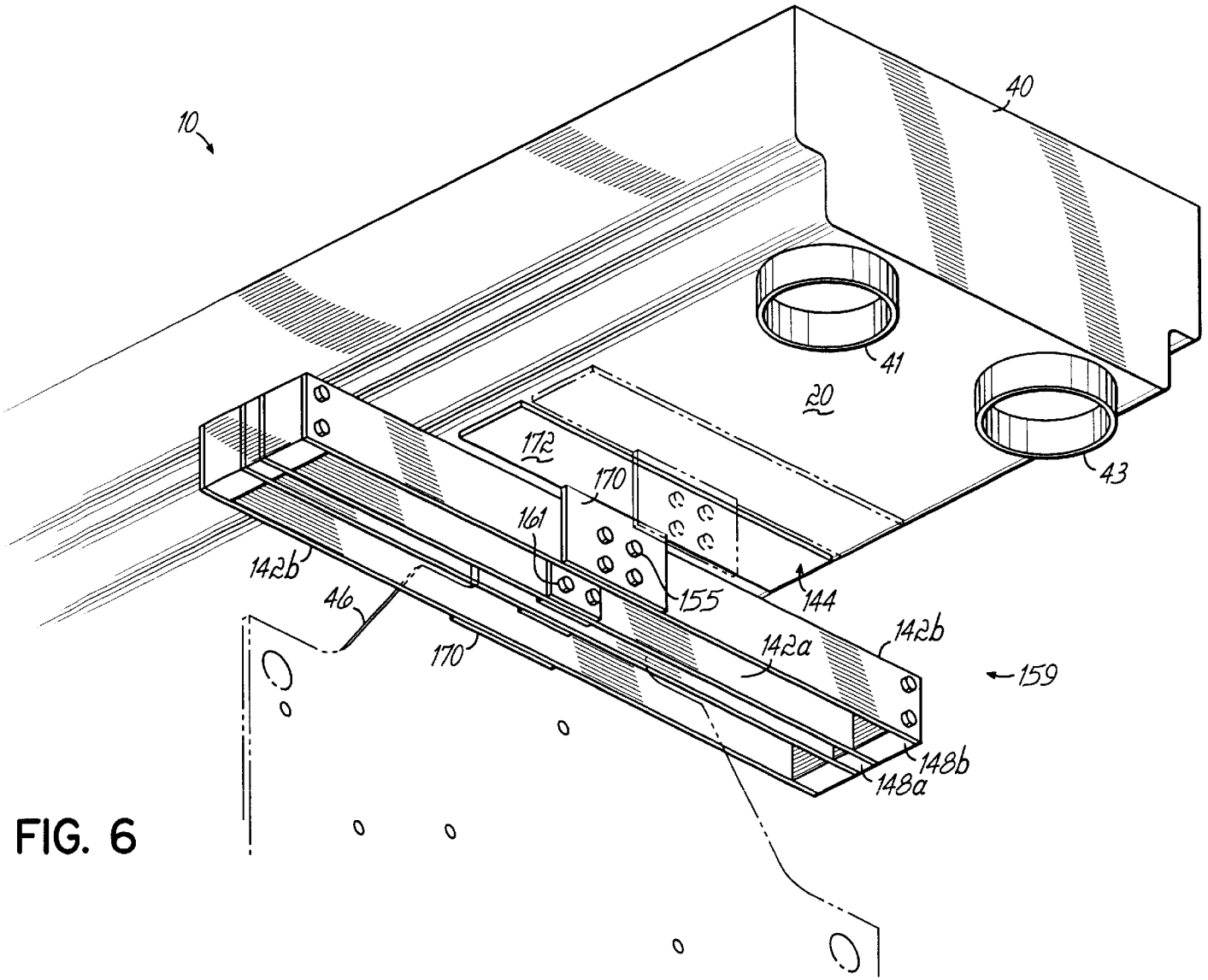
FIG. 6 is a perspective partial view of a leaf spring mounting arrangement in a second embodiment of this invention.
Figure 7A:
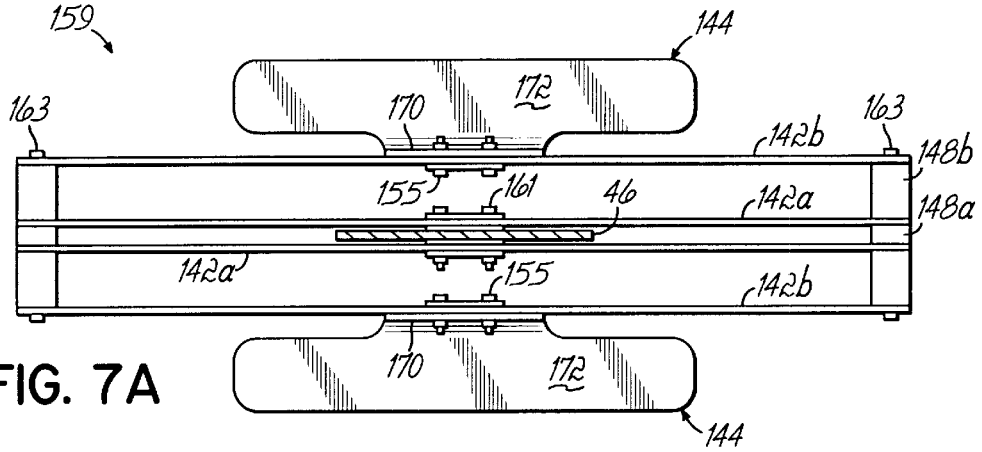
FIGS. 7A and 7B are plan views of the leaf spring mounting arrangement of FIG. 6 in unflexed and flexed configurations, respectively.
Figure 7B:
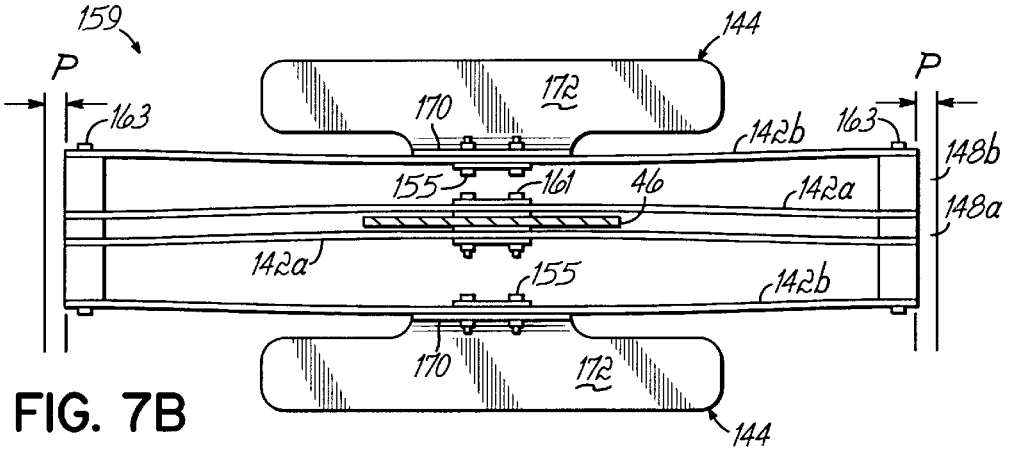
Figure 7C:
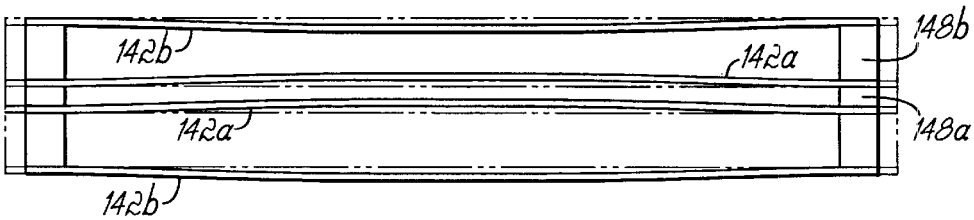
FIG. 7C is a schematic view of the leaf springs in FIGS. 7A and 7B showing their movement between the two configurations.

Referring to FIGS. 6–7C, a second presently preferred embodiment of the screening machine 10 according to this invention is shown. Reference numerals for components which are similar to the screening machine shown in FIGS. 1–3A are likewise used for the embodiment shown in FIGS. 6–7C. A principle difference between the two embodiments of the screening machine 10 is the design of the mounting assembly. In the embodiment shown in FIGS. 6–7C, the mounting assembly 159 supporting the tail end 40 of the screen deck 39 includes a number of generally horizontally oriented leaf springs 142 which combine to form a spring pack arrangement. The mounting assembly 159 is secured to the upwardly projecting tab 46 of the base 22 by a number of bolts 161 or the like. Specifically, in a presently preferred embodiment of the mounting assembly 159, a central or intermediate portion of each of a pair of inner leaf springs 142*a* are secured to opposite faces of the tab 46 by the bolts 161 or the like. The respective outer ends of the two inner leaf springs 142*a* are maintained in a spaced relationship by a shim 148*a*.

The mounting assembly 159 also includes preferably a pair of outer leaf springs 142*b*. Outer ends of the outer leaf springs 142*b* are maintained in a spaced generally parallel relationship with respect to the adjacent inner leaf spring 142*a* by a shim 148*b*. A central or intermediate portion of each of the outer leaf springs 142*b* is secured to the downwardly projecting flange 170 of a mounting bracket 144 by bolts 155 or the like. Each mounting bracket 144 also includes a mounting plate 172 oriented generally perpendicular to the mounting flange 170. Each mounting plate 172 is secured to a bottom of the pan 20 of the screen deck 39. The mounting plate 172 may be welded to the bottom of the screen deck 39 or, alternatively, the mounting plate 172 may be selectively secured in one of multiple alternative locations on the bottom of the screen deck 39 to provide for the appropriate offset or bias of the leaf springs 142*a*, 142*b*. An alternative mounting location for the mounting plate 172 is shown in dashed lines in FIG. 6. Additionally, while the mounting assembly 59, 159 shown and described herein has the outer ends of the springs 42, 142 coupled to the screen deck 39 and the intermediate portion coupled to the base 22, it should be readily understood by those skilled in the art that the outer ends could be coupled to the base and the intermediate portion coupled to the screen deck or other appropriate mounting schemes.

A bottom plan view of the mounting assembly 159 is shown in FIG. 7A in which the leaf springs 142*a*, 142*b* are generally parallel to each other in an unflexed, unbiased or unstressed configuration. A principle advantage of the mounting assembly 159 is that during bending, flexing or stressing of the springs 142*a*, 142*b*, stress upon the mounting bracket 144, tab 46 and/or screen deck 39 is avoided. More specifically, the outer ends of the leaf springs 142*b* deflect through an arc inwardly during movement of the screen deck 39 relative to the base in an amount identified by P in FIG. 7B. Similar deflection of the inner leaf springs 142*a* relative to the outer leaf springs 142*b* avoids the significant tension/compression forces of the springs being transferred to the base 22 and the screen deck 39. As such, fatigue failure of the mounting bracket 144 and other components over extended service is avoided.

Preferably, the leaf springs 142*a*, 142*b* are mounted in a generally horizontal orientation to avoid introducing a vertical component to the movement of the screen deck 39. The symmetrical design of the mounting assembly 159 allows excellent support of all associated loads including the weight of the screen deck 39 at the tail end 40, the bending/deflection loads of the springs and the twist/rotational loads of the springs. The mounting assembly 159 allows for the leaf springs 142*a*, 142*b* to be much shorter than in other applications to accommodate higher loads for larger, heavier screen decks 39.

In alternative embodiments of the mounting assembly 159, the inner leaf springs 142*a* may be combined into a single leaf spring with half the spring rate value of the combined springs as for example, a single inner leaf spring 142*a* with half the height of the outer leaf springs 142*b*.

Preferably, each of the leaf springs 142*a*, 142*b* are identical in configuration and design and made of Scotch-Ply™. In the presently preferred embodiment as shown in FIG. 6, the springs 142*a*, 142*b* are each approximately 22.5 inches long and 2.0 inches tall with a thickness of 0.16 inches. It should be readily appreciated that the springs and their associated parameters are designed for a desired deflection and desired stress levels based upon the spring material parameters. The size and design of the springs as well as the shims is a function of the stroke and desired deflection of the screening machine 10 and proper clearance of the springs, shims and other components of the mounting assembly 159 during operation of the screening machine 10.

In a further alternative embodiment, the mounting assembly 159 may include a single leaf spring 142*b* secured to the screen deck 39 and coupled at its outer ends to a single leaf spring 142*a* mounted to the base 22. However, such an arrangement may induce a rolling effect or pivoting about the lower edge of the leaf spring 142*a*. The mounting assembly 159 is balanced to maintain generally horizontal movement with a pair of inner leaf springs 142*a* and a pair of outer leaf springs 142*b* as shown in FIGS. 6A–7B. FIGS. 7B and 7C show the deflection of the respective leaf springs 142*a*, 142*b* during movement of the screen deck 39 relative to the base 22 and/or as a result of an initial offset or bias when the mounting assembly 159 is coupled to the screen deck 39 and the base 22. The generally parallel arrangement of the leaf springs 142*a*, 142*b* relative to each other is shown in dashed lines in FIG. 7C and the flexed or stressed configuration of the leaf springs 142*a*, 142*b*, as well as the movement of the ends of the leaf springs inwardly is shown in solid lines in FIG. 7C.

Preferably, the outer ends of the leaf springs 142*a*, 142*b* and the associated shims 148*a*, 148*b* are rigidly mounted together by the bolts 163. In one presently preferred embodiment for a screening machine 10 having a stroke of approximately one inch, to account for a one inch deflection of the springs 142*a*, 142*b*, the shims 148*b* are approximately two inches wide and the shims 148*a* are approximately one inch wide. An additional shim or spacer of about 1/32 inch of phenolic may be used on each side of the springs according to the spring manufacturer's recommendations to protect the springs from surface abrasion and dirty environments.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof. For example, various embodiments of the mounting assembly are shown and described herein, but other embodiments are readily within the scope of the following claims. Moreover, various embodiments of leaf springs are shown and described herein, but the term "leaf spring" and variations thereof as used herein and in the following claims encompasses any element or combination of elements which is capable of resilient bending or flexing within one plane but is generally rigid within a perpendicular plane. Likewise, the mounting assembly as disclosed herein may alternatively include components or elements that provide generally uniform flex in all directions.

We claim:

1. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a driver coupled to the screen deck to impart motion within a two-dimensional screening plane generally parallel to the screen deck and promote separation of the particulate material by the screen deck into the first and second portions;

wherein the motion of the screen deck includes sequential movement in first and second opposite directions within the screening plane; and a mounting assembly supporting the screen deck;

wherein the mounting assembly alters a first rate of the movement of the screen deck in the first direction relative to a second rate of the movement of the screen deck in the second direction.

2. The screening machine of claim 1 wherein the mounting assembly increases the first rate.

3. The screening machine of claim 1 wherein the mounting assembly decreases the second rate.

4. The screening machine of claim 1 wherein the mounting assembly increases the first rate and decreases the second rate.

5. The screening machine of claim 1 wherein the mounting assembly further comprises:

at least one leaf spring.

6. The screening machine of claim 5 wherein each leaf spring is initially mounted in a biased orientation.

7. The screening machine of claim 5 wherein each leaf spring is generally planar and is initially mounted in a biased orientation.

8. The screening machine of claim 5 wherein each leaf spring is mounted for deflection in a plane generally parallel to the first and second directions.

9. The screening machine of claim 6 further comprising:

at least one shim mounted in conjunction with each leaf spring to thereby provide the biased orientation.

10. The screening machine of claim 5 further comprising:

a first set of leaf springs mounted to a base supporting the screen deck;

a second set of leaf springs mounted to the screen deck;

wherein corresponding outer ends of the leaf springs in the first and second sets are coupled together.

11. The screening machine of claim 10 wherein the first and second sets of leaf springs each comprise two leaf springs and the leaf springs in the first and second sets are generally parallel to and spaced from one another when the leaf springs are not flexed.

12. The screening machine of claim 11 further comprising:

a plurality of shims secured between the corresponding outer ends of the springs in the first and second sets to maintain the generally parallel and spaced relationship of the leaf springs.

13. The screening machine of claim 11 wherein the leaf springs of the first set are interposed between the leaf springs of the second set.

14. The screening machine of claim 5 wherein each leaf spring is mounted for deflection in a plane generally parallel to the screening plane.

15. The screening machine of claim 1 wherein the screen deck further comprises:

a head end and a tail end with a longitudinal axis extending therebetween;

wherein the first and second directions are generally parallel to the longitudinal axis;

wherein the particulate material is discharged onto the screen deck proximate the head end and the first and second outlets are proximate the tail end.

16. The screening machine of claim 15 wherein the motion of the screen deck further comprises generally linear motion proximate the tail end and non-linear motion proximate the head end.

17. The screening machine of claim 1 wherein the screen deck further comprises:

a collection pan located there below to collect the second portion of the particulate material that passes therethrough; and an inlet proximate the head end through which the particulate material to be screened is discharged.

18. The screening machine of claim 1 wherein the driver imparts vibratory motion to the screen deck.

19. The screening machine of claim 1 further comprising:

a base supporting the screen deck.

20. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a driver coupled to the screen deck to impart motion within a two-dimensional screening plane generally parallel to the screen deck and promote separation of the particulate material by the screen deck into the first and second portions;

wherein the motion of the screen deck includes sequential movement in first and second opposite directions within the screening plane;

a mounting assembly supporting the screen deck;

wherein the mounting assembly alters the movement of the screen deck by at least one of:

(a) accelerating the movement in the first direction, and (b) decelerating the movement in the second direction.

21. The screening machine of claim 20 wherein the mounting assembly both accelerates the movement in the first direction and decelerates the movement in the second direction.

22. The screening machine of claim 20 wherein the mounting assembly further comprises:

at least one leaf spring.

23. The screening machine of claim 22 wherein each leaf spring is initially mounted in a biased orientation.

24. The screening machine of claim 22 wherein each leaf spring is generally planar and is initially mounted in a biased orientation.

25. The screening machine of claim 22 wherein each leaf spring is mounted for deflection in a plane generally parallel to the first and second directions.

26. The screening machine of claim 23 further comprising:

at least one shim mounted in conjunction with each leaf spring to thereby provide the biased orientation.

27. The screening machine of claim 22 further comprising:

a first set of leaf springs mounted to a base supporting the screen deck;

a second set of leaf springs mounted to the screen deck;

wherein corresponding outer ends of the leaf springs in the first and second sets are coupled together.

28. The screening machine of claim 27 wherein the leaf springs of the first set are interposed between the leaf springs of the second set.

29. The screening machine of claim 27 wherein the first and second sets of leaf springs each comprise two leaf springs and the leaf springs in the first and second sets are generally parallel to and spaced from one another when the leaf springs are not flexed.

30. The screening machine of claim 29 further comprising:

a plurality of shims secured between the corresponding outer ends of the springs in the first and second sets to maintain the generally parallel and spaced relationship of the leaf springs.

31. The screening machine of claim 22, wherein each leaf spring is mounted for deflection in a plane generally parallel to the screening plane.

32. The screening machine of claim 20 wherein the screen deck further comprises:

a head end and a tail end with a longitudinal axis extending therebetween;

wherein the first and second directions are generally parallel to the longitudinal axis;

wherein the inlet is proximate the head end and the first and second outlets are proximate the tail end.

33. The screening machine of claim 32 wherein the motion of the screen deck further comprises generally linear motion proximate the tail and non-linear motion proximate the head end.

34. The screening machine of claim 20 wherein the screen deck further comprises:

a collection pan located there below to collect the second portion of the particulate material that passes therethrough; and an inlet proximate the head end through which the particulate material to be screened is discharged.

35. The screening machine of claim 20 wherein the driver imparts vibratory motion to the screen deck.

36. The screening machine of claim 20 further comprising:

a base supporting the screen deck.

37. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a base supporting the screen deck;

a driver coupled to the screen deck to impart vibratory motion to the screen deck and promote separation of the particulate material by the screen deck into the first and second portions;

a first set of leaf springs mounted to the base; and a second set of leaf springs mounted to the screen deck;

wherein corresponding outer ends of the leaf springs in the first and second sets are coupled together and the first and second sets of leaf springs limit the vibratory motion of the screen deck to a two-dimensional screening plane generally parallel to the screen deck.

38. The screening machine of claim 37 wherein the vibratory motion of the screen deck includes sequential movement in first and second opposite directions within the screening plane and each of the leaf springs is oriented generally parallel to the screening plane to permit movement of screen deck only in a direction generally parallel to the first and second directions and within the screening plane.

39. The screening machine of claim 37 wherein at least one of the leaf springs is initially deflected and a resulting bias accelerates the movement of the screen deck in the first direction and decelerates the movement of the screen deck in the second direction.

40. The screening machine of claim 37 wherein the leaf springs alter a first rate of the movement of the screen deck in the first direction relative to a second rate of the movement of the screen deck in the second direction.

41. The screening machine of claim 37 wherein the first and second sets of leaf springs each comprise two leaf springs and the leaf springs in the first and second sets are generally parallel to and spaced from one another when the leaf springs are not flexed.

42. The screening machine of claim 37 further comprising:

a plurality of shims secured between the corresponding outer ends of the springs in the first and second sets to maintain the generally parallel and spaced relationship of the leaf springs.

43. The screening machine of claim 37 wherein the leaf springs of the first set are interposed between the leaf springs of the second set.

44. The screening machine of claim 37 wherein each leaf spring is mounted for deflection in a plane generally parallel to the screening plane.

45. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a base supporting the screen deck;

a driver coupled to the screen deck to impart vibratory motion to the screen deck and promote separation of the particulate material by the screen deck into the first and second portions;

a first set of leaf springs mounted to the base; and a second set of leaf springs mounted to the screen deck;

wherein corresponding outer ends of the leaf springs in the first and second sets are coupled together and an intermediate portion of the leaf springs between the outer ends thereof in the first and second sets is mounted to the base and the screen deck, respectively.

46. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a driver coupled to the screen deck to impart motion to the screen deck and promote separation of the particulate material by the screen deck into the first and second portions;

wherein the motion of the screen deck includes sequential movement in first and second opposite directions;

a mounting means for supporting the screen deck, the mounting means alters the movement of the screen deck by at least one of:

(a) accelerating the movement in the first direction, and (b) decelerating the movement in the second direction.

47. A screening machine comprising:

a perforate screen deck onto which particulate material to be screened is discharged;

a first and a second outlet, a first portion of the particulate mailer that remains atop the perforate screen deck being discharged through the first outlet and a second portion of the particulate material that passes through the perforate screen deck being discharged through the second outlet;

a driver coupled to the screen deck to impart motion to the screen deck and promote separation of the particulate material by the screen deck into the first and second portions;

wherein the motion of the screen deck includes sequential movement in first and second opposite directions; and a mounting assembly supporting the screen deck and including (a) a first set of leaf springs mounted to a base supporting the screen deck;

(b) a second set of leaf springs mounted to the screen deck;

wherein corresponding outer ends of the leaf springs in the first and second sets are coupled together;

wherein an intermediate portion of the leaf springs between the outer ends thereof in the first and second sets is mounted to the base and the screen deck, respectively;

wherein the mounting assembly alters a first rate of the movement of the screen deck in the first direction relative to a second rate of the movement of the screen deck in the second direction.

* * * * *

UNITED STATES PATENT AND TRADEMARK OFFICE

CERTIFICATE OF CORRECTION

PATENT NO. : 6,763,948 B2
DATED : July 20, 2004
INVENTOR(S) : Brady P. Ballman et al.

It is certified that error appears in the above-identified patent and that said Letters Patent is hereby corrected as shown below:

Column 12,
Line 7, replace claim 29, with the following:

--29. A screening machine comprising:

a perforate screen deck onto which particulate material to be screened is discharged;

a first and a second outlet, a first portion of the particulate matter that remains atop the perforate screen deck being discharged through the first outlet and a second portion of the particulate material that passes through the perforate screen deck being discharged through the second outlet;

a driver coupled to the screen deck to impart motion to the screen deck and promote separation of the particulate material by the screen deck into the first and second portions;

wherein the motion of the screen deck includes sequential movement in first and second opposite directions; and a mounting assembly supporting the screen deck and including (a) a first set of leaf springs mounted to a base supporting the screen deck;

(b) a second set of leaf springs mounted to the screen deck;

wherein corresponding outer ends of the leaf springs in the first and second sets are coupled together;

wherein an intermediate portion of the leaf springs between the outer ends thereof in the first and second sets is mounted to the base and the screen deck, respectively;

wherein the mounting assembly alters the movement of the screen deck by at least one of:

(a) accelerating the movement in the first direction, and (b) decelerating the movement in the second direction.

Line 30, replace claim 33, with the following:

33. A screening machine comprising:

a perforate screen deck having a head end, a tail end and a longitudinal axis extending between the head and tail ends;

an inlet proximate the head end through which particulate material to be screened is discharged onto the perforate screen deck;

a first and a second outlet each located proximate the tail end of the perforate screen deck, a first portion of the particulate material that remains atop the perforate screen deck being discharged through the first outlet and a second portion of the particulate material that passes through the perforate screen deck being discharged through the second outlet;

a base positioned below the screen deck to support the screen deck;

a collection pan having spaced side walls and being located below the screen deck to collect the second portion of the particulate material that passes through the screen deck;

UNITED STATES PATENT AND TRADEMARK OFFICE

CERTIFICATE OF CORRECTION

PATENT NO. : 6,763,948 B2 
DATED : July 20, 2004
INVENTOR(S) : Brady P. Ballman et al.

It is certified that error appears in the above-identified patent and that said Letters Patent is hereby corrected as shown below:

Column 12 (cont'd), a drive motor coupled to the screen deck and imparting two-dimensional vibratory motion within a plane to the screen deck to promote separation of the particulate material into the first and second portions, the vibratory motion being defined in part by movement within a plane of the screen deck in first and second opposite directions, each generally parallel with the longitudinal axis; and a leaf spring having spaced outer ends and an intermediate portion, the leaf spring coupling the screen deck proximate the tail end to the base;

wherein the leaf spring is oriented generally parallel to the plane to permit movement of the tail end only in a direction generally parallel to the longitudinal axis of the screen deck and within the plane;

wherein each of the outer ends of the leaf spring are coupled to one of the side walls of the pan and the intermediate portion of the leaf spring is coupled to the base;

wherein the leaf spring is initially deflected and a bias of the leaf spring accelerates the movement of the screen deck in the first direction and decelerates the movement of the screen deck in the second direction.--

Column 14,
Line 25, "mailer" should read -- matter --.

Signed and Sealed this

Fifth Day of April, 2005

JON W. DUDAS
*Director of the United States Patent and Trademark Office*